US005730586A

United States Patent [19]

Sayama

[11] Patent Number: 5,730,586

[45] Date of Patent: Mar. 24, 1998

[54] SUPERCHARGER WITH INTEGRAL BY-PASS PASSAGE

[75] Inventor: Masayuki Sayama, Tochigi-ken, Japan

[73] Assignee: Tochigi Fuji Sangyo Kabushiki Kaisha, Japan

[21] Appl. No.: 653,940

[22] Filed: May 22, 1996

[30] Foreign Application Priority Data

May 25, 1995 [JP] Japan ..... 7-126326

[51] Int. Cl.[6] ..... F02B 33/36; F04B 49/035

[52] U.S. Cl. ..... 417/310; 123/564

[58] Field of Search ..... 123/564; 417/310

[56] References Cited

U.S. PATENT DOCUMENTS 1,285,819 11/1918 Smith ..... 417/310
4,502,283 3/1985 Wandel ..... 417/310
4,823,758 4/1989 Tamura et al. ..... 417/310
4,991,562 2/1991 Chujo ..... 417/310

FOREIGN PATENT DOCUMENTS 1016276 1/1966 United Kingdom ..... 417/310

*Primary Examiner*—Michael Koczo
*Attorney, Agent, or Firm*—Graham & James LLP

[57] ABSTRACT

A supercharger for supercharging intake air to an engine includes a casing which has a suction opening covering a suction-side end of the casing and a discharge opening on the side of the opposite end thereof, and a pair of rotors engaged with each other for compressing intake air introduced from the suction opening to supply the compressed air to the engine via the discharge opening. The casing has therein a communication passage for establishing a communication between the suction opening and the discharge opening. The supercharger also includes a bypass valve for opening and closing the communication passage, and an actuator for actuating the bypass valve.

14 Claims, 8 Drawing Sheets

SUPERCHARGER WITH INTEGRAL BY-PASS PASSAGE

BACKGROUND OF THE INVENTION

1. Field of The Invention

The present invention relates generally to a supercharger for supercharging intake air to an engine for an automotive vehicle. More specifically, the invention relates to a by-pass passage of a supercharger for supercharging intake air to an engine for an automotive vehicle.

2. Description of the Related Art

An example of conventional Roots superchargers for use in an engine for automotive vehicles is disclosed in "Toyota New-Model Sprinter Manual (Article Number: 61325)" (published by Toyota Motor, May 1987, pages 4–19 and 4–21), as shown in FIGS. 1 and 2.

In this example, a Roots supercharger 203 is arranged in an intake system of an engine 201. The supercharger 203 is belt-driven by a crank pulley 205 of the engine 201 via an electromagnetic clutch 207. The on-off control of the electromagnetic clutch 207 is performed by means of an engine control unit 210, so as to make and break the driving of the supercharger 203 in accordance with the running load condition of the engine 201.

When the supercharger 203 is operated, intake air is sucked into the supercharger 203 via an air inlet duct 215 having an air cleaner 209, an air flow meter 211, a throttle valve 213 and so forth, and discharged supercharging air is supplied to the engine 201 via an air outlet duct 217 and an intercooler 219.

On the other hand, when the engine 201 runs in light-load running condition, i.e. when no supercharging is performed, the electromagnetic clutch 207 is turned off by means of the engine control unit 210, and the operation of the supercharger 203 is stopped. At this time, an air bypass valve 221 is open due to negative pressure applied to a diaphragm chamber of the air bypass valve 221, and most of intake air is sucked into an intake manifold 225 via the air bypass valve 221 and a by-pass passage 223.

The air bypass valve 221 is mounted on the air inlet duct 215. A by-pass mechanism including the by-pass passage 223 and the air bypass valve 221 is separated from the supercharger 203.

Furthermore, when the supercharger 203 is operated, atmospheric air is introduced into the diaphragm chamber by means of a vacuum switching valve 227, and the air bypass valve 221 is closed. In addition, when the engine speed is increased to exceed a predetermined value, the air bypass valve 221 is open, and part of supercharging pressure is returned to the air inlet duct 215 via the air bypass valve 221, so that the supercharging pressure is controlled.

However, in this construction wherein the by-pass mechanism is separated from the supercharger 203, the arrangements and mountings of the by-pass passage 223, the air bypass valve 221 and so forth are complicated, and the size of the supercharging system is increased. Therefore, there are problems in that the applicability to automotive vehicles is narrow and that the supercharging system is expensive.

SUMMARY OF THE INVENTION

It is therefore an object of the present invention to eliminate the aforementioned problems and to provide a compact and inexpensive supercharger which has a wide applicability to automotive vehicles.

It is another object of the present invention to provide the supercharger which can be integral with a bypass mechanism.

In order to accomplish the aforementioned and other objects, according to one aspect of the present invention, a supercharger for supercharging intake air to an engine, comprises: a casing having a suction opening formed so as to cover a suction-side end of the casing and a discharge opening formed on the opposite end of the casing; a communication passage provided in the casing for establishing a communication between the suction opening and the discharge opening; a pair of rotors provided in the casing and engaged with each other for compressing intake air introduced from the suction opening to supply the compressed air to an engine via the discharge opening; a bypass valve for opening and closing the communication passage; and an actuator for actuating the bypass valve.

In this supercharger, when the rotors are rotated to supercharge the engine, the bypass valve is closed by means of the actuator to close the communication passage. At this time, the intake air introduced from the suction opening is compressed by the rotors to be discharged from the discharging opening to be supplied to the engine. When the rotors are stopped so as not to supercharge the engine, the bypass valve is open by means of the actuator to open the communication passage. At this time, intake air is supplied to the engine via the suction opening, the bypass valve, the communication passage and the discharge opening. Furthermore, when the supercharging pressure exceeds a predetermined value while the supercharging is performed, the bypass valve may open the communication passage. In this case, the supercharging air on the discharge-opening side flows in a reverse direction to adjust the supercharging pressure.

Since the communication passage is formed in the casing and has the bypass valve, it is unnecessary to provide any outside by-pass passages for supercharging intake air, any bypass valves, any connection members thereof, and so forth. Therefore, it is possible to provide a compact and inexpensive supercharging system which includes the supercharger and which has a wide applicability to automotive vehicles.

Since the communication passage is formed inside the casing, it is possible to obtain cooling effect due to intake air passing through the communication passage from the suction opening to the discharge opening of the supercharger. Therefore, it is possible to restrain thermal expansion of the rotors to stabilize the supercharging performance.

In addition, since the suction opening is so formed as to cover the suction-side end of the casing, all of the suction opening, the discharge opening and the communication passage can be formed on a single side face (a single plane) of the casing, so that it is possible to decrease the whole length of the communication passage and to simplify the structure of the casing.

Moreover, since the suction opening is so formed as to cover the suction-side end of the casing, the outside open face of the suction opening can be arranged in alignment with or perpendicular to the outside open face of the discharge opening, so as to increase the number of the ways of arranging the outside open faces. Therefore, it is possible to increase the number of the side faces to be selected for mounting the supercharger on the engine, so that it is possible to improve the applicability to automotive vehicles.

The communication passage may extend in axial directions of the rotors. In this case, since the communication passage for establishing the communication between the suction and discharge openings is so formed as to extend in axial directions of the rotors, the length of the communication passage can be decreased, and the responsibility of intake air passing through the communication passage can be improved when the engine running condition is switched to non-supercharging running condition. Furthermore, the communication passage can be easily formed by mold or machining, so that the supercharger is inexpensive.

The actuator may be mounted on the casing and so arranged as to face the communication passage via the suction or discharge openings. In this case, since the actuator is mounted on the casing so as to extend the axial directions of the rotors, the width of the casing is not increased. Therefore, it is possible to prevent the supercharger from obstructing peripheral members, and the supercharger can be easily mounted on the side face of the engine. When the supercharger is mounted on a V-type engine, it can be easily mounted between cylinder banks, so that it is possible to improve the applicability to automotive vehicles.

The bypass valve may comprise a valve rod extending in axial directions of the rotors to pass through a wall of the casing on the suction-opening side or the discharge-opening side, and a valve head secured to one end of the valve rod. In this case, since the valve rod of the bypass valve extends in the axial directions of the rotors, the valve head moves along the communication passage extending in the same direction, so that it is possible to stabilize the function for closing the communication passage by means of the valve head.

The communication passage may comprise: a first passage formed in the casing, one end of the first passage communicating with the suction opening and the other end thereof opening to a side face of the casing; a second passage formed in the casing, one end of the second passage communicating with the discharge opening and the other end thereof opening to the side face of the casing; and a third passage mounted on the casing for establishing a communication between the first and second passages in a direction perpendicular to the axial directions of the rotors, and the bypass valve may comprise a valve rod extending along the third passage and a valve head secured to one end of the valve rod for opening and closing the third passage.

In this supercharger, when the rotors are rotated to supercharge the engine, the bypass valve is closed by means of the actuator to close the communication passage. At this time, the intake air introduced from the suction opening is compressed by the rotors to be discharged from the discharging opening to be supplied to the engine. When the rotors are stopped so as not to supercharge the engine, the bypass valve is open by means of the actuator to open the communication passage. At this time, intake air is supplied to the engine via the suction opening, the first passage, the third passage, the bypass valve, the second passage and the discharge opening. Furthermore, when the supercharging pressure exceeds a predetermined value while the supercharging is performed, the bypass valve may also open the communication passage. In this case, the supercharging air on the discharge-opening side flows in a reverse direction to adjust the supercharging pressure.

Since the first and second passages communicate with the bypass valve separated from the casing, the first and second passages can be provided so as to be offset from each other, so that it is possible to increase the number of the ways of selecting the positions and diameters of the passages together with the diameter of the communication passage.

Since the valve head moves along the communication passage, it is possible to stabilize the closing function of the communication passage.

Since the bypass valve can be removed from the casing. Therefore, when it is unnecessary to communicate with the first and second passages, the members for closing the communication passage can be easily mounted on the casing, so that the casing can be commonly used.

In addition, the bypass valve and the actuator can be easily replaced in accordance with the necessity of intermediate control of the by-pass amount passing through the communication passage.

Moreover, since the communication passage in the bypass valve is so arranged as to extend in a direction crossed to the axial directions of the rotors, it is possible to easily prevent the supercharger from obstructing the peripheral members by selecting the crossed angle when it is mounted on an automotive vehicle. In addition, since the outside open faces of the suction and discharge openings can be arranged on the same plane as the side face of the casing on which the bypass valve is mounted, the bypass valve can share the side-face space with the ducts connected to the suction and discharge openings, so that it is possible to improve the applicability to automotive vehicles.

The actuator may be mounted on the bypass valve. In this case, since the actuator is mounted on the bypass valve, it is possible to easily prevent the actuator from obstructing the ducts on the suction and discharge sides, and it is possible to increase the number of the ways of selecting the positions wherein the supercharger does not obstruct the periperal members when it is mounted on an automotive vehicle.

The valve head of the bypass valve may move toward the discharge opening of the casing to close the communication passage when it is closed, and move toward the suction opening of the casing to open the communication passage when it is open. In this case, the bypass vale moves toward the suction opening of the casing to open the communication passage when it is open. Therefore, when the bypass valve is open in a case where the supercharging pressure is increased to exceed a predetermined value, excessive supercharging pressure on the discharge-opening side is added as opening force, so that it is possible to decrease the force for operating the bypass value by means of the actuator.

The valve head of the bypass valve may move toward the suction opening of the casing to close the communication passage when it is closed, and move toward the discharge opening of the casing to open the communication passage when it is open. In this case, since the valve head moves toward the discharge opening (toward the second passage) to open the communication passage when it is open, the negative pressure of intake air produced by the engine on the discharge-opening side is added to the valve head in the moving direction thereof, so that it is possible to decrease the force for operating the bypass valve by means of the actuator.

The valve head may contact a conical valve seat formed in the communication passage to close the communication passage. In this case, since the valve seat is so formed as to be conical, it is possible to surely seal the communication passage and to prevent air leakage. In addition, it is possible to decrease the flow resistance at the valve and seat portions, and to improve the responsibility.

According to another aspect of the present invention, a supercharger for supercharging intake air to an engine, comprises: a casing having a suction opening for introducing intake air into the casing, and a discharge opening for discharging the intake air to an engine; compression means for compressing the intake air introduced from the suction opening to supply the compressed air to the engine in a supercharging mode wherein the supercharger is operated; communication passage means provided in the casing for establishing a communication between the suction opening and the discharge opening; valve means, associated with the communication passage means, for opening the communication passage means in an non-supercharging mode wherein the supercharger is not operated and for blocking the communication passage means in the supercharging mode, the valve means also opening the communication passage means when the pressure of the compressed air exceeds a predetermined value in the supercharging mode; and actuator means for actuating the valve.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, particularly to FIGS. 3 and 4, the first preferred embodiment of a screw type supercharger according to the present invention will be described below.

Figure 1:
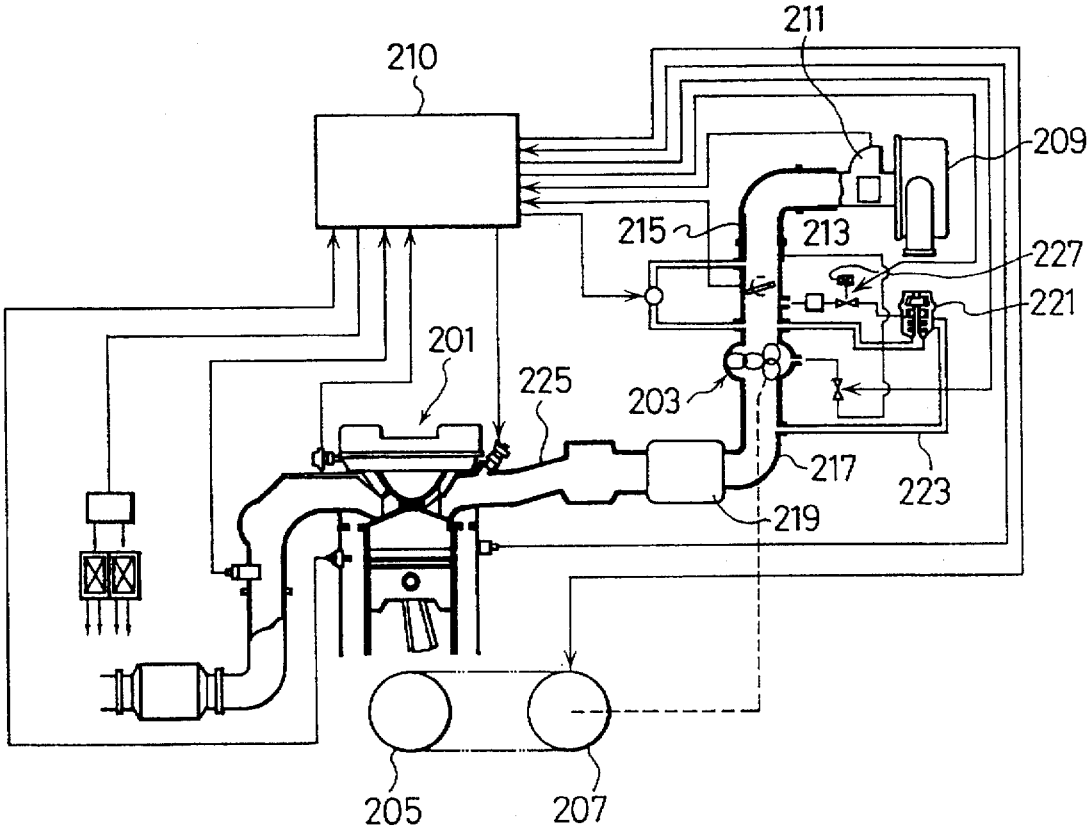
FIG. 1 PRIOR ART
FIG. 1 is a schematic view showing a conventional supercharging system.
Figure 2:
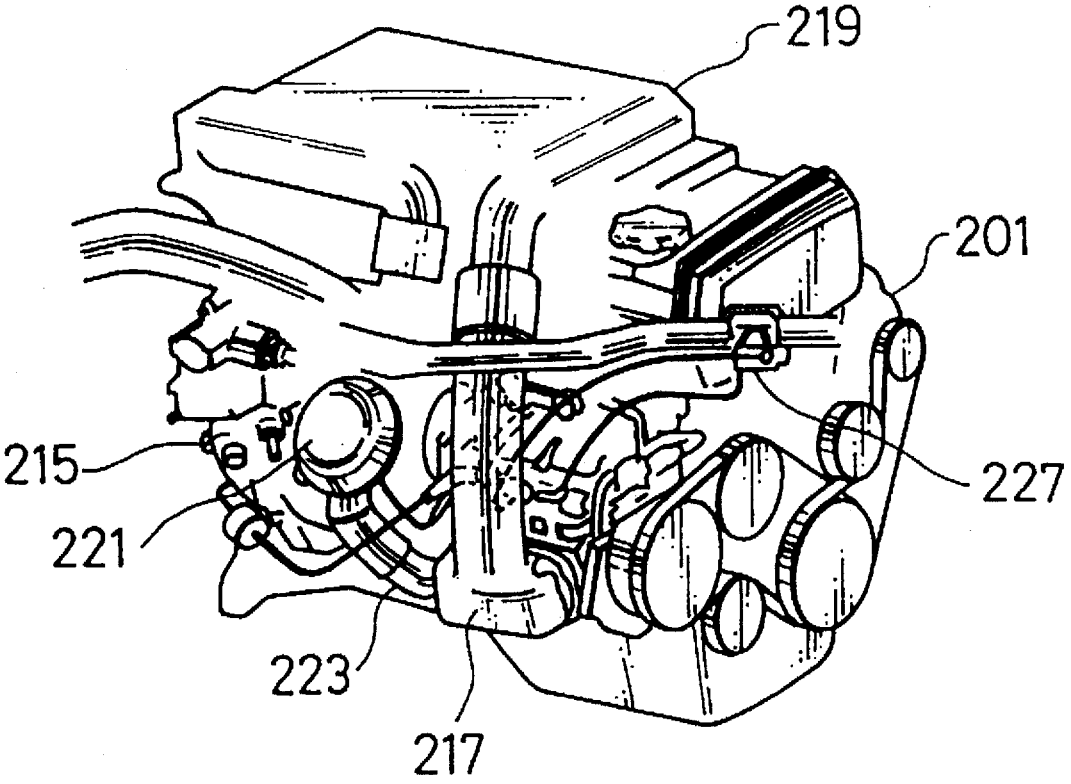
FIG. 2 PRIOR ART
FIG. 2 is a perspective view showing a conventional supercharging system.
Figure 3:
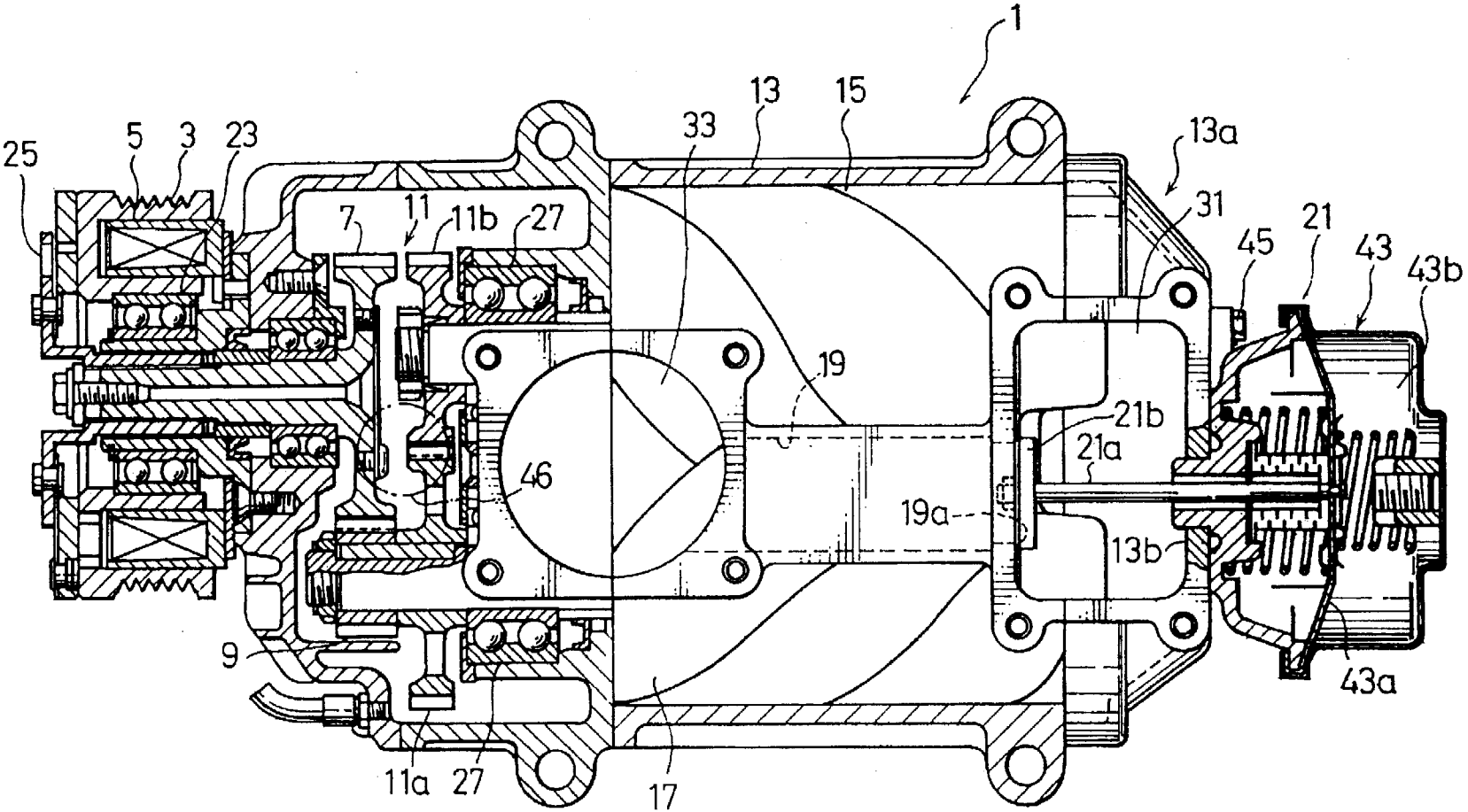
FIG. 3 is a partially-sectioned, plan view of the first preferred embodiment of a supercharger according to the present invention.
Figure 4:
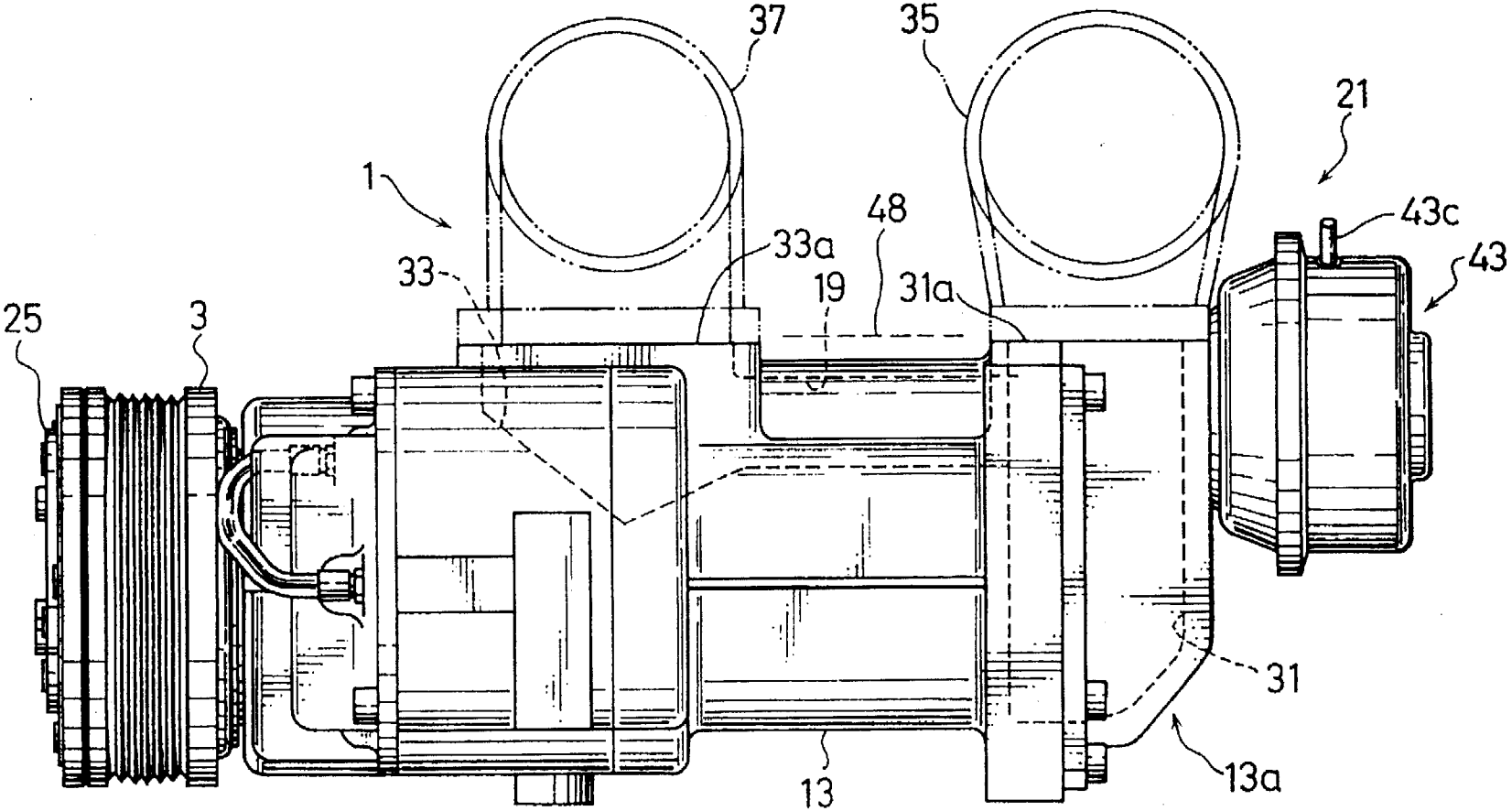
FIG. 4 is a side elevation of the supercharger of FIG. 3.

FIG. 3 is a partially-sectioned, plan view of the first preferred embodiment of a screw type supercharger according to the present invention, and FIG. 4 is a side elevation thereof.

As shown in FIG. 3, a supercharger 1 comprises a pulley 3, an electromagnetic clutch 5, a drive gear 7, a step-up gear 9, a set of timing gears 11, a casing 13, a pair of male and female rotors 15 and 17, a by-pass passage (communication passage) 19, and a bypass valve 21.

The pulley 3 is rotatably supported on the casing 13 via a bearing 23, and belt-driven by means of an engine. The electromagnetic clutch 5 is arranged inside the pulley 3. When the electromagnetic clutch 5 is turned on, the driving force of the engine is transmitted to the step-up gear 9 via the pulley 3, a coupling 25 and the drive gear 7. The set of timing gears 11 comprise a timing gear 11*a*, together with the step-up gear 9, secured to the left end of the female rotor 17, and a timing gear 11*b* secured to the left end of the male rotor 15. The timing gears 11*a* and 11*b* are engaged with each other.

The pair of male and female rotors 15 and 17 are rotatably supported on the casing 13 via bearings 27. Similar to the left end of the rotors 15 and 17, the right end (not shown) of the rotors 15 and 17 are also rotatably supported on the casing 13 via bearings. The pair of male and female rotors 15 and 17 rotate synchronously by the engagement of the timing gears 11*a* and 11*b* while maintaining slight clearances between the rotors and between each rotor and the casing 13. Furthermore, the on-off control of the electromagnetic clutch 5 is performed by an engine control unit (not shown) in accordance with the running load condition of the engine. When the electromagnetic clutch 5 is ON, the rotors 15 and 17 are rotated to supercharge the engine, and when it is OFF, the rotors 15 and 17 are stopped so as not to supercharge the engine.

The casing 13 is formed with a suction opening 31 which covers the end faces of the pair of male and female rotors 15 and 17 at a location opposite to a discharge opening 33. That is, the suction opening 31 is so formed as to cover a suction-side end 13*a*, and the discharge opening 33 is formed on the opposite end side. The outside open faces 31*a* and 33*a* of the suction opening 31 and the discharge opening 33 are formed in alignment with one side of the casing 13. The suction opening 31 communicates with an air inlet duct 35 on the side of an air cleaner, and the discharge opening 33 communicates with an air outlet duct 37 on the side of an intercooler. Within the one side of the casing 13 wherein the outside open faces 31*a* and 33*a* of the suction opening 31 and the discharge opening 33 are formed, the by-pass passage 19 for establishing the communication between the suction opening 31 and the discharge opening 33 is so formed as to extend in the axial directions of the rotors 15 and 17 as shown in FIG. 3.

The bypass valve 21 comprises a valve rod 21*a* and a valve head 21*b* secured to one end thereof. As shown in FIG. 3, the valve rod 21*a* extends in the axial directions of the rotors 15 and 17 so as to pass through a wall 13*b* of the casing 13 on the side of the suction opening 31. When the valve head 21*b* moves toward the discharge opening 38 in the axial directions of the rotors 15 and 17 to contact a seat 19*a* of the by-pass passage 19, the by-pass passage 19 is closed. On the other hand, when the valve head 21*b* moves toward the suction opening 31 to be apart from the seat 19*a*, the by-pass passage 19 is open. Furthermore, the relationship between the moving direction of the valve head 21*b* and the open and closing functions of the by-pass passage 19 may be reversed.

As shown in FIG. 3, an actuator 43 is integrally assembled with the bypass valve 21, and is secured to the casing 13 by means of a bolt 45 on the opposite side of the by-pass passage 19 via the suction opening 31. Inside the actuator 43, a diaphragm 43*a* is arranged at the center thereof so as to divide the interior of the actuator 43 into two chambers, an outside chamber 43*a* of which communicates with the air inlet duct 35 via a duct line 43*c*. The other end of the valve rod 21*a* is secured to the center of the diaphragm 43*a*. When negative pressure is introduced from the air inlet duct 35 into the outside chamber 43*b*, the valve head 21*b*, together with the diaphragm 43*a*, moves to the right (in FIG. 3) to open the by-pass passage 19. When the negative pressure is returned, the valve head 21*b* moves to the left to contact the seat 19*a* to close the by-pass passage 19.

Furthermore, unlike the aforementioned construction, both of the bypass valve 21 and the actuator 43 may be arranged on the side of the discharge opening 33.

As mentioned above, the supercharger 1 includes supercharging members having the by-pass passage 19 and the bypass valve 21. The whole supercharger 1 is mounted on the engine body by utilizing the side face opposite to the outside open faces 31*a*, 33*a* of the suction opening 31 and the discharge opening 33.

With this construction, the operation of the supercharger 1 will be described below.

When the engine runs in light-load running condition, the electromagnetic clutch 5 is turned off by means of the engine control unit, so that the supercharger 1 is stopped to allow the engine to run in non-supercharging running condition. At this time, since the valve head 21*b* moves to the right due to negative pressure of the air inlet duct 35 on the air cleaner side to open the by-pass passage 19, intake air is supplied to the engine through the by-pass passage 19.

On the other hand, when the engine runs in heavy-load running condition, the electromagnetic clutch 5 is turned on by means of the engine control unit, so that the supercharger 1 is operated to supercharge intake air to the engine. At this time, the valve head 21*b* moves to the left due to the decrease of negative pressure of the air inlet duct 35, so as to contact the seat 19*a* to close the by-pass passage 19. Furthermore, when the supercharging pressure to the engine is increased to exceed a predetermined value, the closed by-pass passage 19 is open, a part of the supercharging pressure is returned to the suction opening 31 to prevent the engine and so forth from being damaged.

As mentioned above, according to this preferred embodiment, the by-pass passage 19 is formed inside the casing 13, and the by-pass passage 19 is provided with the bypass valve 21. Therefore, unlike the conventional supercharger, it is unnecessary to provide an external bypass passage, a bypass valve thereof, and a connecting member thereof. Therefore, it is possible to provide a compact and inexpensive supercharging system which has a wide applicability to automotive vehicles.

Furthermore, since the by-pass passage 19 is formed inside the casing 13, it is possible to obtain cooling effect due to intake air passing through the by-pass passage 19. Therefore, it is possible to restrain thermal expansion of the rotors 15 and 17 to stabilize supercharging performance.

In addition, the suction opening 31 is so formed as to cover the suction-side end 13*a* of the casing 13, and the by-pass passage 19 is formed along the outside open face 33*a* of the discharge opening 33. Therefore, all of the suction opening 31, the discharge opening 33 and the by-pass passage 19 can be formed on a single side face (a single plane) of the casing 13, so that it is possible to decrease the whole length of the by-pass passage 19 and to simplify the structure of the casing 13.

Moreover, since the suction opening 31 is so formed as to cover the suction-side end 13*a* of the casing 13, the outside open face 31*a* of the suction opening 31 can be arranged in alignment with or perpendicular to the outside open face 33*a* of the discharge opening 33, so as to increase the number of the ways of arranging the outside open faces 31*a* and 33*a*. Therefore, it is possible to increase the number of the side faces to be selected for mounting the supercharger on the engine, so that it is possible to improve the applicability to automotive vehicles.

Since the by-pass passage 19 extends linearly in the axial directions of the rotor 15 and 17, the length of the by-pass passage 19 can be decreased, and the responsibility of intake air can be improved when the engine running condition is switched to non-supercharging running condition. Furthermore, the by-pass passage 19 can be easily formed by mold or machining, so that the supercharger is inexpensive.

The actuator 43 and the bypass valve 21 may be arranged at a location 46 opposite to the by-pass passage 19 via the discharge opening 33.

Since the actuator 43 is so arranged as to extend in the axial directions of the rotors 15 and 17, the width of the casing 13 is not increased. Therefore, it is possible to prevent the supercharger 1 from obstructing peripheral members when it is mounted on the vehicle, so that it can be easily mounted on the side face of the engine. When the supercharger 1 is mounted on a V-type engine, it can be easily mounted between cylinder banks, so that it is possible to improve the applicability to automotive vehicles.

Since the valve rod 21*a* extends in the axial directions of the rotors 15 and 17, the valve head 21*b* moves along the by-pass passage 19, so that it is possible to stabilize the closing function of the valve head 21*b*.

Since all of the valve rod 21*a*, the valve head 21*b*and the actualtor 43 are secured to the side of the suction opening 31, the cooling effect due to intake air can be obtained, and the normal operation of the bypass valve 21 can always be performed even if the actuator 43 is a pneumatic actuator.

In addition, when the valve head 21*b* is open, it moves toward the suction opening 31 to open the by-pass passage 19. Therefore, when the valve head 21*b* is open in a case where the supercharging pressure exceeds a predetermined value, excessive supercharging pressure on the side of the discharge opening 33 is added as opening force, so that it is possible to decrease the operation force necessary for operating the valve head 21*b* by means of the actuator 43.

Figure 5:
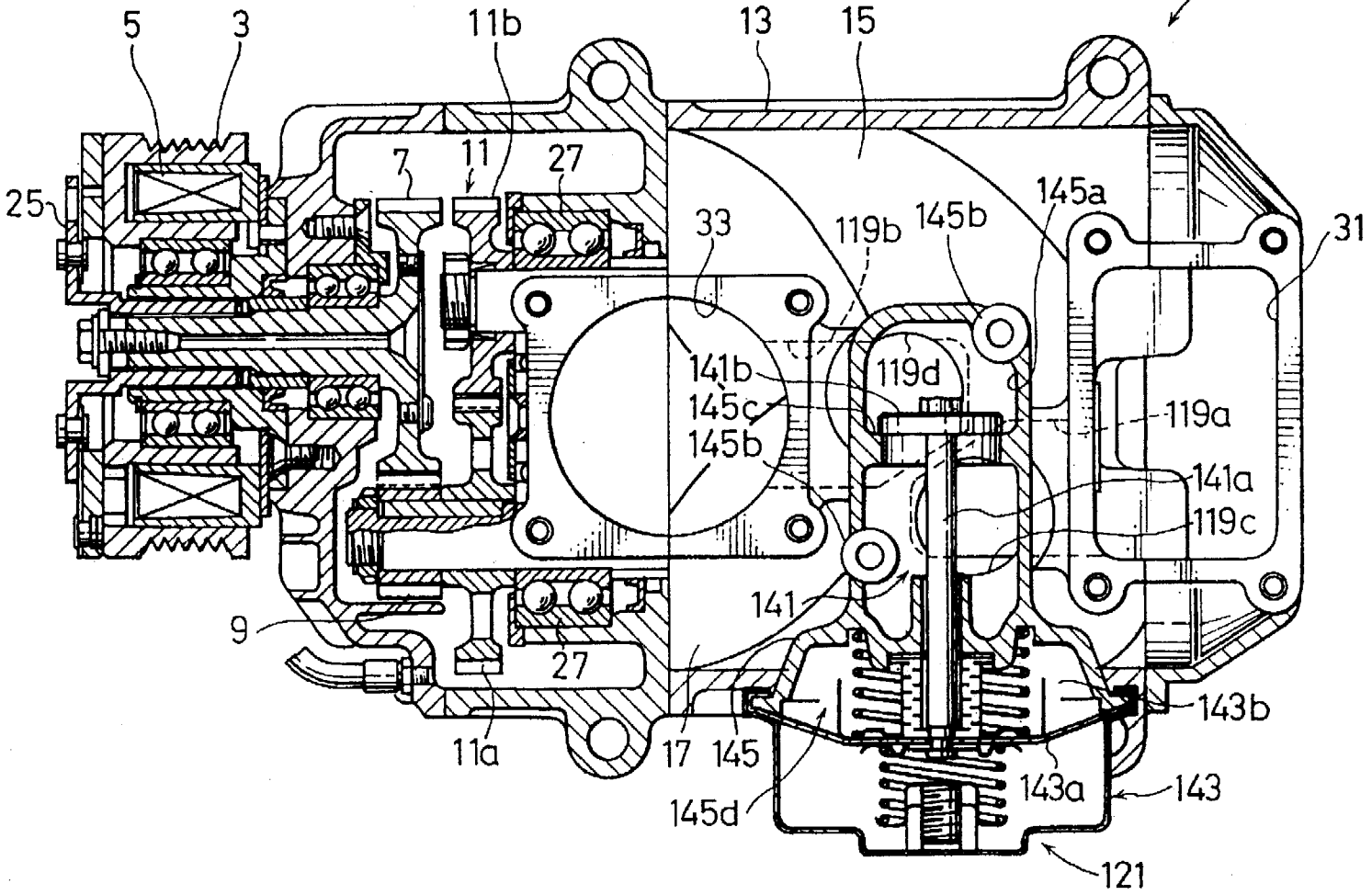
FIG. 5 is a partially-sectioned, plan view of the second preferred embodiment of a supercharger according to the present invention.
Figure 6:
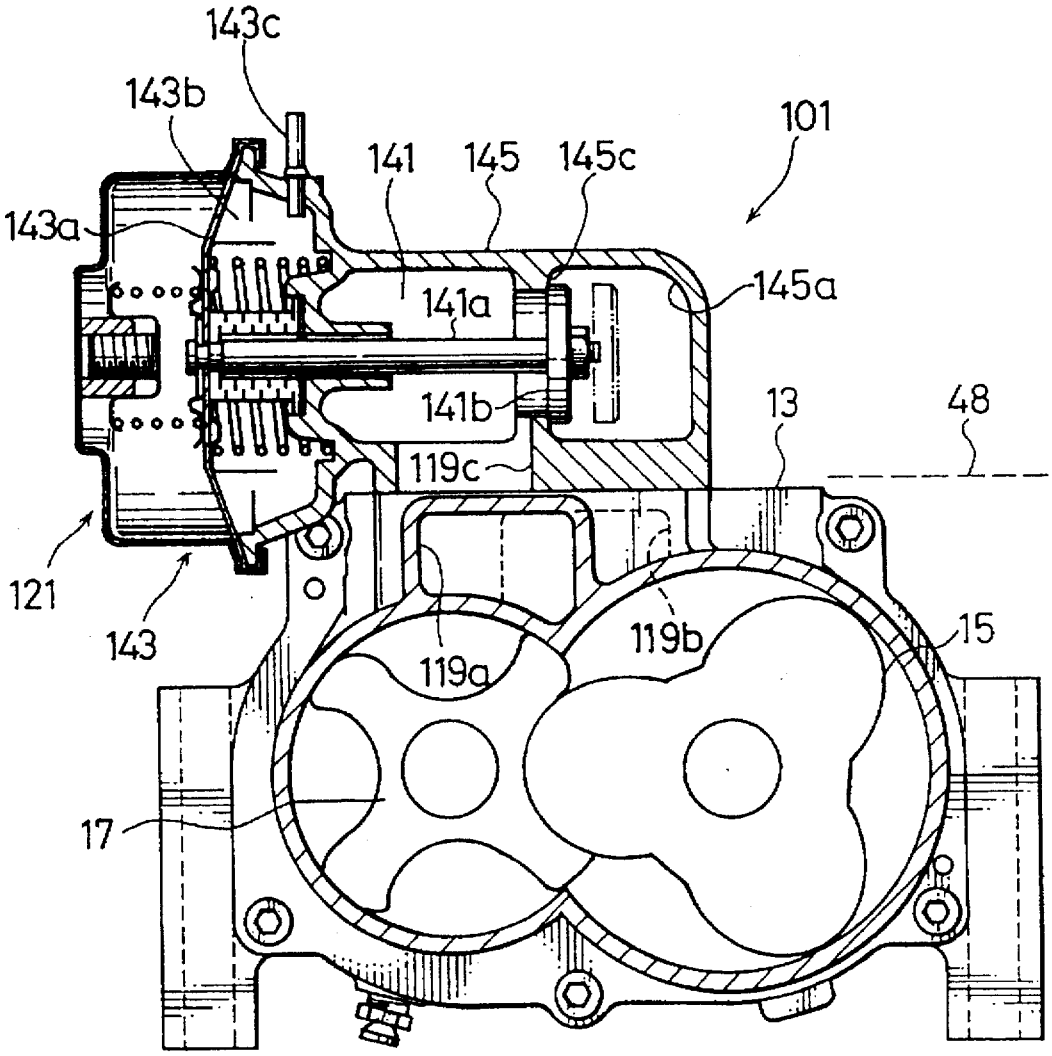
FIG. 6 is a transverse section of the supercharger of FIG. 5.

Referring to FIGS. 5 and 6, the second preferred embodiment of a supercharger according to the present invention will be described below.

FIG. 5 is a partially-sectioned, plan view of the second preferred embodiment of a screw type supercharger according to the present invention, and FIG. 6 is a transverse section thereof.

The construction of the supercharger in this preferred embodiment is substantially the same as that of the aforementioned first preferred embodiment, except for the arrangements of the by-pass passage and the bypass valve. Therefore, this difference will be mainly described, and the repeated descriptions are omitted. Furthermore, the same reference numbers are used for the members having the same functions as those in the first preferred embodiment.

As shown in FIG. 5, in this supercharger 101, a first by-pass passage 119*a*, one end of which communicates with the suction opening 31, is so formed as to extend in the casing 13 to a location near the center of the casing 13 in the axial directions of the rotors 15 and 17. Similarly, a second by-pass passage 119*b*, one end of which communicates the discharge opening 33, is so formed as to extend from the discharge opening 33 to a location near the center of the casing 13. The other end of each of the first and second by-pass passages 119*a* and 119*b* has an opening 119*c* or 119*d* on the same side face of the casing 13 as shown in FIG. 5.

A bypass valve 121 comprises a valve body 145 having a communication passage 145*a*, and a valve portion 141 provided in the communication passage 145*a*.

The valve body 145 is mounted on mounting portions 145*b* of the casing 13. In this mounting condition, the inside communication passage 145*a* is so arranged as to be perpendicular (or crossed) to the axes of the rotors 15 and 17, and establishes the communication between the openings 119c and 119d.

The valve portion 141 comprises a valve rod 141a, and a valve head 141b fixed to one end thereof. The valve rod 141a is arranged along the communication passage 145a. When the valve head 141b moves toward the first by-pass passage 119a (toward the suction opening 81) to contact a seat 145c of the valve body 145, it closes the communication passage 145a. On the other hand, when the valve head 141b moves toward the second by-pass passage 119b (toward the discharge opening 38) to be apart from the seat 145c, it opens the communication passage 145a. Furthermore, the relationship between the moving directions of the valve head 141b and the open and closing functions of the by-pass passage 119a may be reversed.

An actuator 143 is mounted in an opening 145d of the valve body 145 to be secured thereto by calking. The interior of the actuator 143 is divided by a diaphragm 143a into two chambers, an inside chamber 143b of which communicates with the air inlet duct 35 via a duct line 143c. The other end of the valve rod 141a is secured to the center of the diaphragm 143a. When negative pressure in the air inlet duct 35 is introduced into the inside chamber 143b via the duct line 143c, the valve head 141b, together with the diaphragm 143a, moves to the right in FIG. 6 to open the communication passage 145a, and when negative pressure is returned thereto, the valve head 141b moves to the left to contact the seat 145c to close the communication passage 145a.

With this construction, according to this preferred embodiment, in addition to the same functions and advantageous effects as those of the first preferred embodiment, the supercharger can be mounted on an automotive vehicle, the mounting space of which is relatively small in the axial directions of the supercharger, so that it is possible to improve the applicability to automotive vehicles.

Furthermore, since the first and second by-pass passages 119a and 119b communicate with the bypass valve 121 separated from the casing 13, the first and second by-pass passages 119a and 119b are provided so as to be offset from each other. Therefore, it is possible to increase the number of the ways of selecting the positions and diameters of the first and second by-pass passages 119a and 119b, together with the diameter of the communication passage 145a.

In addition, the bypass valve 121 can be removed from the casing 13. Therefore, when it is unnecessary to communicate with the first and second by-pass passages 119a and 119b, members for closing the openings 119c and 119d can be easily mounted on the casing 13, so that the casing 13 can also be used for a supercharger in which no by-pass passages are required.

In addition, the bypass valve 121 can be easily replaced in accordance with the necessity of intermediate control of the by-pass amount passing through the communication passage 145a.

Moreover, the communication passage 145a inside the bypass valve 121 is so arranged as to extend in a direction crossed to the axial directions of the rotors 15 and 17 (in a direction perpendicular thereto in this preferred embodiment), and the actuator 143 is assembled integrally with the valve portion 141 and the valve body 145. Therefore, it is possible to easily prevent the supercharger including the actuator 143 from obstructing the air inlet duce 35 and the air outlet duct 37 by selecting the crossed angle. In addition, since the outside open faces 31a and 33a of the suction opening 31 and the discharge opening 33 are arranged on the same plane as the side face of the casing 13 on which the bypass valve 121 is mounted, the bypass valve 121 by itself does not occupy the lateral space of the casing 13 when the supercharger is mounted on an automotive vehicle. Therefore, the bypass valve 121 can share the lateral space of the casing 13 with the air inlet duct 35 and the air outlet duct 37, so that it is possible to improve the applicability to automotive vehicles.

In addition, since the valve head 141b moves along the communication passage 145a, the closing function can be stabilized. When the communication passage 145a is open in a case where the electromagnetic clutch 5 is turned off during the partial loading of the engine, the valve head 141b moves toward the second by-pass passage 119b (toward the discharge opening 33) to open the communication passage 145b. At this time, the negative pressure of intake air produced by the engine on the side of the discharge opening 33 is added to the valve head 141b in the moving direction thereof, so that it is possible to decrease the operation force of the actuator 143.

Figure 7:
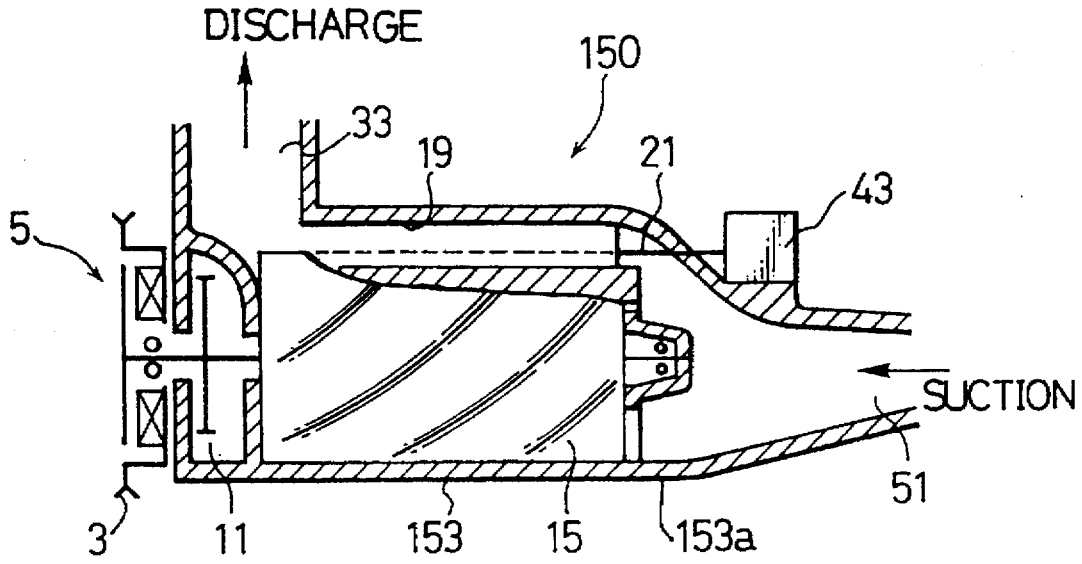
FIG. 7 is a schematic sectional view of the third preferred embodiment of a supercharger according to the present invention.

Referring to FIG. 7, the third preferred embodiment of a supercharger according to the present invention will be described below.

FIG. 7 is a schematic sectional view of a screw type supercharger in this preferred embodiment.

In a supercharger 150 in this preferred embodiment, the arrangement of the suction opening is different from that in the aforementioned first preferred embodiment, and other constructions are the same as those in the first preferred embodiment. Therefore, this difference will be described and the repeated descriptions are omitted. Furthermore, the same reference numbers are used for the members having the same functions as those in the aforementioned first preferred embodiment.

A casing 153 has a suction opening 151 which extends in the axial direction of the rotor 15 so as to cover the suction-side end 153a of the casing 153. The arrangements of the discharge opening 33, the by-pass passage (communication passage) 19, the bypass valve 21 and the actuator 43 are the same as those in the aforementioned first preferred embodiment. The by-pass passage 19 is arranged along the side face 48 in FIG. 4 in the first preferred embodiment, or along the side face 148 in FIG. 6 in the aforementioned second preferred embodiment.

The arrangement of the suction opening 151 should not be limited the arrangement wherein the discharge opening 33 opens in the side face of the casing as the first preferred embodiment. That is, the suction opening 151 is formed in the casing 153 so as to cover the suction-side end 153a of the casing 153, so that it is possible to increase the number of the ways of arranging the outside open face of the suction opening 151.

According to this preferred embodiment, the suction opening 151 is arranged along the longitudinal axis of the rotor 15. Therefore, in addition to the advantageous effects obtained by the aforementioned preferred embodiment, the supercharger in this preferred embodiment can be easily mounted on an automotive vehicle while restraining the increase of the number of exclusive parts, in a case where this arrangement is desired due to the restricted spece on the engine side when the supercharger is mounted on the automotive vehicle.

Figure 8:
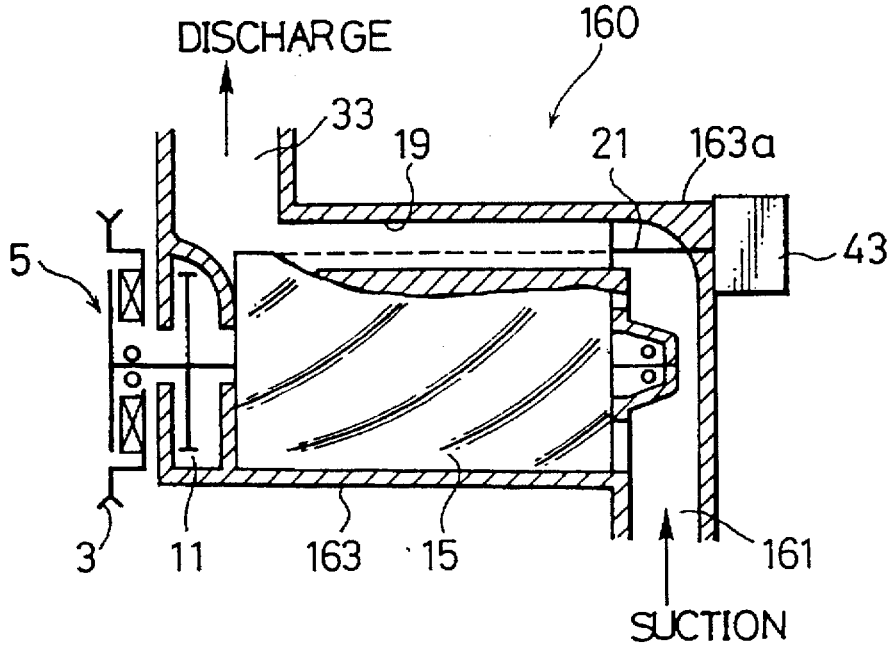
FIG. 8 is a schematic sectional view of the fourth preferred embodiment of a supercharger according to the present invention.

Referring to FIG. 8, the fourth preferred embodiment of a supercharger according to the present invention will be described below.

FIG. 8 is a schematic sectional view of a screw type supercharger in this preferred embodiment.

In a supercharger 160 in this preferred embodiment, the arrangement of the suction opening is different from that in the aforementioned first preferred embodiment, and other constructions are the same as those in the first preferred embodiment. Therefore, this difference will be described and the repeated descriptions are omitted. Furthermore, the same reference numbers are used for the members having the same functions as those in the first preferred embodiment.

A casing 163 has a suction opening 161 which extends in a direction perpendicular to the axial direction of the rotor 15 so as to cover the suction-side end 163*a* of the casing 163 and which opens on the side face opposite to the discharge opening 33. The arrangements of the discharge opening 33, the by-pass passage (communication passage) 19, the bypass valve 21 and the actuator 43 are the same as those in the aforementioned first preferred embodiment. The by-pass passage 19 is arranged along the side face 48 in FIG. 4 in the first preferred embodiment, or along the side face 148 in FIG. 6 in the aforementioned second preferred embodiment.

The arrangement of the suction opening 161 should not be limited the arrangement wherein the discharge opening 33 opens in the side face of the casing as the first preferred embodiment. That is, the suction opening 161 is formed in the casing 163 so as to cover the suction-side end 163*a* of the casing 163, so that it is possible to increase the number of the ways of selecting the arrangement of the outside open face of the suction opening 161.

According to this preferred embodiment, the suction opening 161 is arranged in a direction perpendicular to the longitudinal axis of the rotor 15, and the suction opening 161 and the discharge opening 33 are open on the side opposite to the casing 163. Therefore, in addition to the advantageous effects obtained by the aforementioned preferred embodiment, the supercharger in this preferred embodiment can be easily mounted on an automotive vehicle while restraining the increase of the number of exclusive parts, in a case where this arrangement is desired due to the restricted spece on the engine side when the supercharger is mounted on the automotive vehicle.

Figure 9:
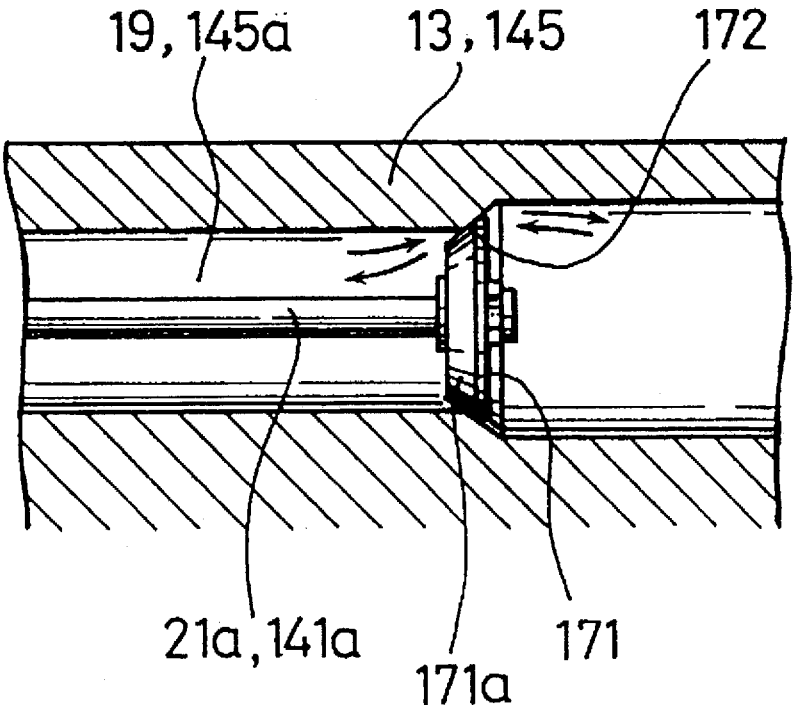
FIG. 9 is sectional view of a modified valve mechanism according to the present invention.

Referring to FIG. 9, a modified valve mechanism for use in a supercharger according to the present invention will be described below.

The communication passage 19 or 145*a* is provided with the valve rod 21*a* or 141*a*, one end of which is provided with a valve head 171. On the outer periphery of the valve head 171 on the side of the valve rod 21*a* or 141*a*, a conical, valve-side seat 171*a* is formed. In the inner surface of the communication passage 19 or 145*a*, a conical, passage-side seat 172 for contacting the valve-side seat 171*a* is formed. When the valve rod 21*a* or 141*a* moves in the axial directions, the seats 171*a* and 172 are brought into contact with or appart from each other, so that the communication passage is closed or open.

According to this modified valve mechanism, since the passage-side seat 172 is conical, it is possible to surely seel the communication passage and to prevent air leakage. Since the valve-side seat 171*a* is also conical, it is possible to more surely seel the communication passage. In addition, since the passage-side seat 171 is conical, air between both seats smoothly flows along the inner wall of the communication passage 19 or 145*a* as shown by the arrow in FIG. 9. Therefore, it is possible to decrease the flow resistance of suction and exhaust air and to improve the responsibility. Moreover, since the valve-side seat 171*a* is also conical, it is possible to more greatly decrease the flow resistance of the suction and exhaust air.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A supercharger for supercharging intake air to an engine, comprising:

a casing having a suction opening formed so as to cover a suction-side end of the casing, and a discharge opening formed on the side of the opposite end of the casing;

a communication passage provided in said casing for establishing a communication between said suction opening and said discharge opening;

a pair of rotors provided in said casing and engaged with each other for compressing intake air introduced from said suction opening to supply the compressed air to an engine via said discharge opening;

a bypass valve for opening and closing said communication passage; and an actuator for actuating said bypass valve, wherein said communication passage extends in axial directions of said rotors.

2. A supercharger as set forth in claim 1, wherein said actuator is mounted on said casing, said actuator being arranged as to face said communication passage via said suction or discharge openings.

3. A superchager as set forth in claim 1, wherein said bypass valve comprises a valve rod extending in axial directions of said rotors to pass through a wall of said casing on a suction-opening side or a discharge-opening side, and a valve head secured to one and of said valve rod.

4. A supercharger as set forth in claim 2, wherein said communication passage comprises: a first passage formed in said casing, one end of the first passage communicating with said suction opening and the other end thereof opening to a side face of said casing; a second passage formed in said casing, one end of the second passage communicating with said discharge opening and the other end thereof opening to the side face of said casing; and a third passage mounted on said casing for establishing a communication between said first and second passages in a direction perpendicular to the axial directions of said rotors, and wherein said bypass valve comprises a valve rod extending along said third passage and a valve head secured to one end of the valve rod for opening and closing said third passage.

5. A supercharger as set forth in claim 4, wherein said actuator is mounted on said bypass valve.

6. A supercharger as set forth in claim 1, wherein the valve head of said bypass valve moves toward said discharge opening of said casing to close said communication passage when it is closed, and moves toward said suction opening of said casing to open said communication passage when it is open.

7. A supercharger as set forth in claim 6, wherein said valve head contacts a conical valve seat formed in said communication passage to close said communication passage.

8. A supercharger as set forth in claim 1, wherein the valve head of said bypass valve moves toward said suction opening of said casing to close said communication passage when it is closed, and moves toward said discharge opening of said casing to open said communication passage when it is open.

9. A rotary positive displacement supercharger for supercharging intake air to an engine, the supercharger comprising:

a dual screw compressor mechanism for compressing the intake air, the compressor mechanism being composed of a pair of rotors;

a housing for accommodating therein the compressor mechanism, the housing including:

a first end wall portion formed with a suction opening for introducing the intake air into the air compressor mechanism;

a second end wall portion formed with a discharge opening for discharging the intake air compressed at the compressor mechanism; and a single wall enclosure portion interconnecting the first and second end wall portions with each other in an axial direction of the compressor mechanism, enclosing the pair of rotors; and a bypass mechanism for interconnecting the suction opening and the discharge opening with each other, the bypass mechanism comprising:

a path extending in the axial direction, the path being formed in the enclosure portion; and a valve mechanism for opening and closing the path.

10. A rotary positive displacement supercharger according to claim 9, wherein the valve mechanism comprises:

a valve facing the path;

a rod for supporting the valve; and an actuator for actuating the rod;

the suction opening is directed at a radial direction of the first end wall portion; and the rod is provided through the first end wall portion so that it is actuatable in the axial direction.

11. A rotary positive displacement supercharger according to claim 9, wherein the path comprises:

a first path part communicating with the suction opening; and a second path part communicating with the discharge opening;

the valve mechanism comprises:

a communication path for intercommunicating the first and the second path part with each other;

a valve installed in the communication path;

a rod for supporting the valve; and an actuator for actuating the rod; and the communication path has part thereof defined by an external member applicable to the enclosure portion so that the rod is actuatable in a crossing direction to the axial direction.

12. A rotary positive displacement supercharger according to claim 9, wherein the suction opening is directed in the axial direction.

13. A rotary positive displacement supercharger according to claim 9, wherein the path is formed in a recessed part of the enclosure portion covering an intermediate region between the pair of rotors.

14. A supercharger for supercharging intake air to an engine, the supercharger comprising:

a compressor including:

a suction opening for introducing the intake air;

a combination of rotor chamber and a pair of rotors fitted therein for compressing the introduced intake air;

a discharge opening for discharging the compressed intake air; and a rotor housing having a first wall portion formed with the suction opening;

a second wall portion formed with the discharge opening; and a third wall portion extending between the first and second wall portions for defining the rotor chamber therein; and a bypass system for conducting the intake air to bypass the rotor chamber between the suction opening and the discharge opening, the bypass system comprising:

a communication route formed substantially over the length thereof within the third wall portion for the suction opening and the discharge opening to communicate therethrough with each other; and a valve mechanism for opening and closing the communication route.

* * * * *